US008757422B2

(12) United States Patent
Nishizaki et al.

(10) Patent No.: US 8,757,422 B2
(45) Date of Patent: Jun. 24, 2014

(54) CRYOGENIC TANK

(75) Inventors: Takeyoshi Nishizaki, Nishinomiya (JP); Motohiko Nakatani, Sakai (JP); Tomoki Ushida, Kyotanabe (JP)

(73) Assignee: Osaka Gas Co., Ltd., Osaka (JP)

( * ) Notice: Subject to any disclaimer, the term of this patent is extended or adjusted under 35 U.S.C. 154(b) by 0 days.

(21) Appl. No.: 13/574,439

(22) PCT Filed: Jan. 21, 2011

(86) PCT No.: PCT/JP2011/051106
§ 371 (c)(1),
(2), (4) Date: Oct. 5, 2012

(87) PCT Pub. No.: WO2011/093227
PCT Pub. Date: Aug. 4, 2011

(65) Prior Publication Data

US 2013/0200077 A1 Aug. 8, 2013

(30) Foreign Application Priority Data

Jan. 28, 2010 (JP) ..... 2010-017269

(51) Int. Cl.
*F17C 3/06* (2006.01)

(52) U.S. Cl.
USPC ..... 220/560.1; 220/560.12; 220/560.14; 220/560.15

(58) Field of Classification Search
CPC ..... F17C 13/001
USPC ..... 220/560.04–560.15; 52/649.1, 223.2, 52/852
See application file for complete search history.

(56) References Cited

U.S. PATENT DOCUMENTS

| | | | | |
|---|---|---|---|---|
| 3,822,520 | A * | 7/1974 | Crom, Jr. | 52/223.2 |
| 2003/0136071 | A1 * | 7/2003 | Kobayashi | 52/414 |
| 2009/0223974 | A1 * | 9/2009 | Felius | 220/560.12 |

FOREIGN PATENT DOCUMENTS

| | | | |
|---|---|---|---|
| DE | 2712197 | A * | 9/1978 |
| DE | 2712197 | A1 | 9/1978 |
| GB | 776077 | | 6/1957 |
| GB | 1448359 | | 9/1976 |
| GB | 1516150 | | 6/1978 |
| GB | 1516150 | A * | 6/1978 |
| JP | 50128817 | | 10/1975 |
| JP | 5828235 | B2 | 6/1983 |
| JP | 5940697 | U | 3/1984 |

(Continued)

OTHER PUBLICATIONS

DE_2712197.pdf.*

(Continued)

*Primary Examiner* — Mickey Yu
*Assistant Examiner* — Allan Stevens
(74) *Attorney, Agent, or Firm* — The Webb Law Firm

(57) ABSTRACT

There is provided a cryogenic tank having a dual construction for storing ultralow temperature liquid with improvement which allows simplicity in its construction and readiness of setup and allows reduction in the setup, yet achieves high reliability. For accomplishing the above-noted object, in a cryogenic tank having a dual construction with an inner tank for storing low-temperature liquefaction fluid therein and an outer tank enclosing the bottom and the shell of the inner tank. The inner tank includes a bottomed inner vessel formed of concrete and an inner cold resistant relief covering the inner face of the inner vessel. The outer tank includes a bottomed outer vessel formed of concrete and an outer cold resistant relief covering the inner face of the outer vessel.

7 Claims, 6 Drawing Sheets

(56) References Cited

FOREIGN PATENT DOCUMENTS

| | | | |
|---|---|---|---|
| JP | 10101191 | A | 4/1998 |
| JP | 2000346294 | A | 12/2000 |
| JP | 2002284288 | A | 10/2002 |
| JP | 2005350092 | A | 12/2005 |
| JP | 2006275128 | A | 10/2006 |
| WO | 0248602 | A1 | 6/2002 |
| WO | WO 0248602 | A1 * | 6/2002 |

OTHER PUBLICATIONS

DE_2712197_drawings.pdf.*
GB_1516150.pdf.*
GB_1516150_drawings.pdf.*
WO_0248602.pdf.*
WO_0248602.drawings.pdf.*

* cited by examiner

CRYOGENIC TANK

TECHNICAL FIELD

The present invention relates to a cryogenic tank for storing a low-temperature liquefaction fluid such as liquefied natural gas (LNG), liquefied petroleum gas (LPG), liquefied ethylene gas (LEG), etc.

BACKGROUND ART

As shown in FIG. 5, conventionally, a cryogenic tank for storing the above-described low-temperature liquefaction fluid comprises a dual construction including an inner tank 3, an outer tank 6 and an insulation 14 interposed therebetween. Further, the lateral side of the outer tank 6 comprises an integrated assembly of an outer shell 13 having air-tightness for preventing intrusion of moisture component from the outside, and a dike 4 for preventing spreading or diffusion of low-temperature liquefaction fluid L to the outside when the liquid L accidentally leaks from the inner tank 3.

According to a construction conventionally employed as such dual construction cryogenic tank, its inner tank 3 is constructed as a metal tank, and its outer tank 6 is comprised of the outer shell 13 of a metal lining construction and the dike 4 formed of concrete material.

More particularly, the inner tank 3 is constructed as a steel vessel made of e.g. 9% nickel steel (9% Ni steel) having high toughness at ultralow temperatures in order to store therein the low-temperature liquefaction fluid L (about −160° C. in the case of LNG) (see Patent Document 1). The dike 4 portion of the outer tank 6 is formed of e.g. concrete material so as to temporarily preventing leakage of the low-temperature liquefaction fluid L when or if this fluid L should leak from the inner tank 3. As this concrete material, there is employed pre-stressed concrete (PC) provided with enhanced strength by applying compression force to concrete material. Further, on the inner face of the concrete dike constituting the outer tank 6, there is provided a cold resistant relief formed of glass mesh, polyurethane foam or the like. Namely, when the low-temperature liquefaction fluid L comes into direct contact with the inner face of the concrete of the outer tank 6, this may cause crack in association with sudden change in the temperature of the concrete face due to the direct contact, which crack would prevent the dike from providing its intended function. The above layer is provided for preventing such inconvenience (see Patent Document 2).

[Patent Document 1] Japanese Patent Application "Kokai" No. Hei. 10-101191

[Patent Document 2] Japanese Patent Application "Kokai" No. 2002-284288

DISCLOSURE OF THE INVENTION

Object to be Achieved by Invention

With the cryogenic tanks disclosed in Patent Document 1 and Patent Document 2 described above, since the inner tank 3 is formed of an expensive metal such as 9% Ni steel, these tanks suffered the problem of high material cost.

Further, as described above, if the inner tank 3 is formed of a metal such as 9% Ni steel while the outer tank 6 is formed of concrete, different constructions employed are for the inner tank 3 and the outer tank 6 and different materials are used also therefor. As a result, the management of setup tends to be relatively complicated and the setup requires much experience and much time as well.

The present invention has been made in order to overcome the above-described problems and its object is to provide a cryogenic tank having a dual construction for storing ultralow temperature liquid with improvement which allows simplicity in its construction and readiness of setup and allows reduction in the setup (setup and material costs), yet achieves high reliability.

Solution

For accomplishing the above-noted object, according to the characterizing feature of the present invention, a cryogenic tank having a dual construction with an inner tank for storing low-temperature liquefaction fluid therein, an outer tank enclosing the bottom and the shell of the inner tank, and an insulation interposed between the inner tank and the outer tank, wherein said inner tank includes a bottomed inner vessel formed of concrete and an inner cold resistant relief covering the inner face of the inner vessel; and said outer tank includes a bottomed outer vessel formed of concrete and an outer cold resistant relief covering the inner face of the outer vessel.

With the above-described characterizing feature, the low-temperature liquefaction fluid is stored within the inner vessel formed of concrete whose inner face is covered with an inner cold resistant relief. With this, heat transfer of the cold heat from the low-temperature liquefaction fluid can be appropriately buffered by the inner cold resistant relief, whereby the inner vessel formed of concrete can be protected appropriately. As a result, in spite of the construction forming the inner tank of concrete, generation of significant temperature difference within the body can be restricted, thereby to prevent generation of crack, so that the low-temperature liquefaction fluid can be stored for a predetermined period of time in a reliable manner.

Further, as the inner tank is formed basically of concrete, rather than such relatively costly material as 9% Ni steel, the material cost can be restricted. Moreover, as the inner and the outer tanks can have a substantially identical construction, the setup and management of the setup of the cryogenic tank as a whole can be facilitated. For instance, the setup period can be reduced, thus reducing the setup cost. And, it is possible to reduce the cost required for the measure conventionally taken to cope with the problem which would arise from the fact of the materials used for forming the inner tank and the outer tank being different. Moreover, the experience conventionally accumulated with regard to the outer tank can be utilized sufficiently.

Furthermore, as an insulation is provided between the inner tank and the outer tank, intrusion of heat to the low-temperature liquefaction fluid from the outside can be appropriately restricted.

For the reasons mentioned above, it has now become possible to provide a cryogenic tank with improvement which allows reduction in the period and cost required for its setup and which allows also storage of the low temperature liquefied fluid for an extended period of time in a reliable manner.

According to a further characterizing feature of the cryogenic tank of the present invention, said inner cold resistant relief includes a glass mesh which comes into contact with the low-temperature liquefaction fluid and a polyurethane foam on whose surface the glass mesh is provided and which is disposed on the side of the inner vessel.

With the above-described characterizing feature, the inner cold resistant relief consists essentially of a polyurethane foam as insulating material and a glass mesh provided on the surface of the urethane foam and acting as a surface reinforcing material. And, this glass mesh has good resistance against stress due to cold heat shock. Hence, when the low-temperature liquefaction fluid comes into direct contact with the polyurethane foam, the glass mesh effectively prevents cracking thereof. As a result, the surface of the polyurethane foam as insulating material can be effectively reinforced by the glass mesh and occurrence of damage to the polyurethane foam due to cold heat shock can be appropriately restricted. And, the polyurethane foam provides distinguished heat insulating performance to protect the concrete inner vessel satisfactorily.

According to a still further characterizing feature of the present invention, said inner cold resistant relief comprises a cold resistant relief formed integral with and covering the entire inner face of said inner vessel, and said cold resistant relief includes a glass mesh which comes into contact with the low-temperature liquefaction fluid and a polyurethane foam provided on the surface of said glass mesh and disposed on the side of said inner vessel;

said outer cold resistant relief includes a bottom side cold heat resistant relief provided on the inner face of the bottom of said outer vessel and a shell side cold resistant relief provided on the inner face of the shell portion of said outer vessel, said bottom side cold resistant relief being formed of perlite concrete, and said shell side cold heat resistant relief includes a glass mesh which comes into contact with the low-temperature liquefaction fluid and a polyurethane foam provided on the surface of said glass mesh and disposed on the side of said inner vessel.

With the cryogenic tank of the present invention, the intended object of the inner tank is storage of low-temperature liquefaction fluid under a low temperature condition. Whereas, the intended object of the outer tank, as described also above, is prevention of diffusion or spilling of any amount of low-temperature liquefaction fluid which may inadvertently have leaked from the inner tank. And, in the case of the above-described construction of the invention, while the inner tank and the outer tank have substantially same construction, the entire loads of the low-temperature liquefaction fluid and the inner tank need to be born by the bottom of the outer tank. Then, the inner cold resistant relief is constructed as a cold resistant relief formed integrally with and covering the entire inner face of the inner vessel, so as to secure required storage performance and to minimize the influence of cold heat to the concrete forming the inner vessel as much as possible.

On the other hand, with regard to the outer cold resistant relief, its function is divided between the bottom side cold resistant relief provided on the inner face of the bottom of the outer vessel and the shell side cold resistant relief provided on the inner face of the shell portion of the outer vessel, so that on the side of the bottom, sufficient cold heat buffering performance is ensured while the loads to be received can be coped with sufficiently. Meanwhile, the bottom side cold resistant relief can be formed of a material having high heat insulating performance and load resistance. For instance, the perlite concrete can be used advantageously. With this, there can be obtained a cryogenic tank having high reliability.

Further, in the above-described construction, preferably, on top of the bottom side cold resistant relief formed of perlite concrete, there is disposed a bottom base for the inner vessel formed of concrete, via an insulation comprising a perlite concrete in a hollow tubular form as shown in FIG. 2 and a particulate perlite charged in the hollow portion.

With the above construction, as seen from the bottom of the cryogenic tank, the concrete layer constituting the outer vessel, the perlite concrete layer constituting the bottom side cold resistant relief, the particulate concrete layer constituting the insulation and the concrete layer constituting the inner vessel are arranged in this mentioned order.

With the invention, it is possible to obtain a highly reliable cryogenic tank capable of effectively withstanding cold heat load and weight load, without using relatively costly 9% Ni steel which was conventionally employed for forming the inner tank.

According to a still further characterizing feature of the present invention, a rebar embedded in the concrete forming the inner vessel comprises a 1 mm non-V-notched rebar that satisfies the following Conditions (a) and (b) at a designed lowest operating temperature at or higher than −160° C. and at or lower than 20° C.;

Condition (a): non-notched breaking elongation (100 mm or more distance between gauge points away by 2 d or more from the breaking position) should be at or greater than 3.0%, where d is the diameter of the rebar; and Condition (b): notch sensibility ratio (NSR) should be 1.0 or greater.

[Mathematical Formula 1]

$$NSR = \frac{\text{(tensile strength of notched sample)}}{\text{(0.2\% proof stress or yield stress of non-notched sample)}}$$

Referring to some specific examples of the temperate of the concrete forming the inner vessel, in the case of −165° C. LNG, the temperature of the concrete can be as low as −150° C., as shown in FIG. 4. For this reason, the standard rebar provided under JIS (Japanese Industrial Standards) cannot be used for the concrete forming the outer vessel. Instead, for determining its operating temperature, there is implemented a notch elongation test provided under EN14620 (European standard: Design and manufacture of site built, vertical, cylindrical, Flat-bottomed steel tanks for the storage of refrigerated gases with operating temperatures between 0° C. and −165° C., 2006) and there is employed a rebar that satisfies specified values relating to "non-notched breaking elongation" and "notch sensibility ratio". For example, for use at −165° C., a rebar which has received aluminum deacidification treatment with blast furnace material is suitably employed.

Incidentally, in the above-described notch elongation test, the upper limit values of "non-notched breaking elongation" and "notch sensibility ratio" of the rebar for use in the concrete forming the inner vessel will be restricted by physical property limit values of the material (i.e. rebar with aluminum deacidification treatment). Hence, as long as the value is at or greater than the specified lower limit value, any rebar available that has a value at or higher than this specified lower limit value can be employed.

[Notch Elongation Test]

In the evaluation of tenacity and toughness of the rebar, the elongation test will be conducted with using a 1 mm V-notched or non-notched rebar under the designed lowest operating temperature (from −160° C. to 20° C.). And, the rebar should satisfies the requirements of the following items.

(a): non-notched breaking elongation (100 mm or more distance between gauge points away by 2 d or more from the breaking position) should be at or greater than 3.0%, where d is the diameter of the rebar; and (b): notch sensibility ratio (NSR) should be 1.0 or greater.

[Mathematical Formula 1]

$$NSR = \frac{\text{(tensile strength of notched sample)}}{\text{(0.2\% proof stress or yield stress of non-notched sample)}}$$

As a result of the above, there can be obtained an inexpensive, yet highly reliable cryogenic tank, using mainly concrete, not metal for low temperature, in forming its inner vessel.

On the other hand, referring to some specific examples of the temperate of the concrete forming the outer vessel, in the case of −165° C. LNG, the temperature of the concrete is about 13° C. as shown in FIG. 3 And, even at the time of emergency of liquid leakage, the temperature is still about −12° C., as shown in FIG. 4, which is at or higher than −20° C. and relatively close to the room temperature. For this reason, for this concrete forming the outer vessel, the standard concrete for rebar specified under e.g. JIS G3112, can be suitably employed.

According to a still further characterizing feature of the present invention, said inner tank includes an inner vessel whose top is open and there are also provided a ceiling plate for sealing the top opening and a dome-shaped roof for covering the outer tank including the ceiling plate from above; and in the shell portion, said insulation formed between said inner tank and said outer tank comprises solid insulation and on the side of the dome-shaped roof of the ceiling plate, there is provided an insulation formed of solid insulation; and an air heat insulating layer is provided inside said dome-shaped roof.

With the above-described characterizing construction, in case the inner tank is constructed as the top-open type, the ceiling plate can be provided and on top of this, a dome-shaped roof can be provided. And, on the shell, heat insulation is provided between the inner tank and the outer tank with the solid insulation and on the back side and the upper side of the ceiling plate, there are also provided solid insulation layers for restricting intrusion of heat to the inner tank from the outside.

In use, the cryogenic tank of the invention is kept under the normal temperature condition, at the time of its setup and prior to introduction of low-temperature liquefaction fluid. And, at the time of introduction of the low-temperature liquefaction fluid, an amount of LNG will be diffused mainly from the top of the cryogenic tank so as to sufficiently reduce the temperature inside the cryogenic tank (cool-down), thereafter, the low-temperature liquefaction fluid will be charged successively from the bottom side of the cryogenic tank. Namely, during the cool-down, in the inner tank, its bottom and shell portion connected to this bottom will be cooled rapidly from the normal temperature to the temperature of the low-temperature liquefaction fluid. In the course of this cooling process, the inner vessel will be deformed from the shape shown in FIG. 8(*a*) to the shape shown in FIG. 8(*b*). That is, as to the bottom portion, there occurs warping deformation as its peripheral edge portions will rise relative to the central portion and as to the shell portion, the bottom side and opening end side will have reduced diameters, whereas the central portion in the vertical direction of the tank will bulge radially outward. With occurrence of such deformation, as to the bottom portion, the lower side in the vertical direction of the tank is subjected to a tensile stress, whereas as to the central portion, in the vicinity and upper side of this central portion, a tensile-stressed condition can occur on the outer diameter side.

Further, in the shell portion, there is the possibility of occurrence of deformation because of deformation due to temperature difference between the outside and the inside of the shell portion. And, in the joint between the shell portion and the bottom portion, there is the possibility of occurrence of penetrating crack along the vertical direction of the shell portion because of restraint due to rigidity difference therebetween.

In general, concrete material has high load bearing capacity against compressive stress, but has poor load bearing capacity against tensile stress. Then, in consideration of introduction of low-temperature liquefaction fluid, as to the bottom portion and the shell portion, it is preferred that the stress applied to respective portion be limited to compressive stress or restricted range.

Next, a construction capable of realizing such stress condition will be explained Shell Portion According to a still further characterizing feature of the present invention, at the upper opening edge of the shell portion of the inner vessel, there is formed an opening side shell portion having a greater thickness than the bottom side shell portion.

With the above, due to the provision of the opening side shell portion having increased thickness at the upper opening edge, it is possible to restrict deformation on the upper opening edge and to restrict the tensile stress occurring at the time of introduction of low-temperature liquefaction fluid within the restricted range. As a result, it is possible to provide the shell portion, in particular, the portion from the central portion in the vertical direction of the tank to the portion upward thereof can be provided with increased load bearing capacity.

Consequently, it becomes possible to obtain a highly reliable cryogenic tank that has high load bearing capacity against temperature load due to cold heat at the time of introduction of the low-temperature liquefaction fluid.

For the reasons described above, preferably, the opening side shell portion is formed upwardly of an intermediate high position of the shell portion in the tank height direction.

Further, preferably, the opening side shell portion is formed as a circular thick portion extending downward from the upper opening edge. With use of this circular thick portion, the load bearing capacity of the cryogenic tank can be improved with a relatively simple construction.

FIG. 9 shows a deformed condition of the cryogenic tank corresponding to FIG. 8. In the case of this construction, the inner vessel deforms from the shape shown in FIG. 9(*a*) to the shape shown in FIG. 9(*b*).

Bottom Portion

According to a still further characterizing feature of the present invention, the bottom portion of the inner vessel is formed as a flat planar portion having a predetermined thickness; and under the normal temperature condition prior to introduction of the low-temperature liquefaction fluid, the central portion of the bottom portion is formed as a center convex shape which extends upward in the tank height direction relative to the shell portion connecting peripheral edge portion thereof.

With the above construction wherein the central portion of the bottom portion is formed as a center convex shape which extends upward in the tank height direction relative to the shell portion connecting peripheral edge portion thereof, even if deformation occurs in the bottom portion at the time of receipt of the low-temperature liquefaction fluid, the tensile stress resulting therefrom can be restricted within the controlled range. Hence, the load bearing capacity of the bottom portion can be increased As a result, it is possible to obtain a highly reliable cryogenic tank having high load bearing capacity against cold heat load and weight load at the time of introduction of the low-temperature liquefaction fluid.

Further, as a measure addressing to the same object as above, preferably, the bottom portion of the inner tank is formed as a flat planar bottom portion having a predetermined thickness; and a rebar introduced to the bottom portion is disposed downwardly of the vertical center of the center of the cross section of the bottom portion in the height direction of the tank. Alternatively, the rebar can be disposed in a downwardly convex manner. In this case, there is achieved the additional effect of restricting deformation of the bottom portion. An example of such rebar is a steel material providing a prestress to concrete, etc.

If the rebar is disposed downwardly of the vertical center of the center of the cross section of the bottom portion in the height direction of the tank, even when there tends to occur the deformation described hereinbefore with reference to FIG. 8, the rebar can prevent such deformation in the concrete and restrict the amount of bending deformation (the amount of deformation extending toward the lower side of the bottom portion). As a result, it is possible to confine the generated tensile stress within the restricted range, hence, the load bearing capacity of the bottom portion can be increased. That is, it is possible to obtain a highly reliable cryogenic tank having high load bearing capacity against cold heat load and weight load at the time of introduction of the low-temperature liquefaction fluid.

Similarly, in consideration to the effect of the rebar, preferably, the concrete material comprises PC provided with enhanced resistance against tensile force with application of compression force to concrete material.

MODE OF EMBODYING THE INVENTION

Next, a cryogenic tank according to the present invention will be described in details with reference to the accompanying drawings.

Figure 1:
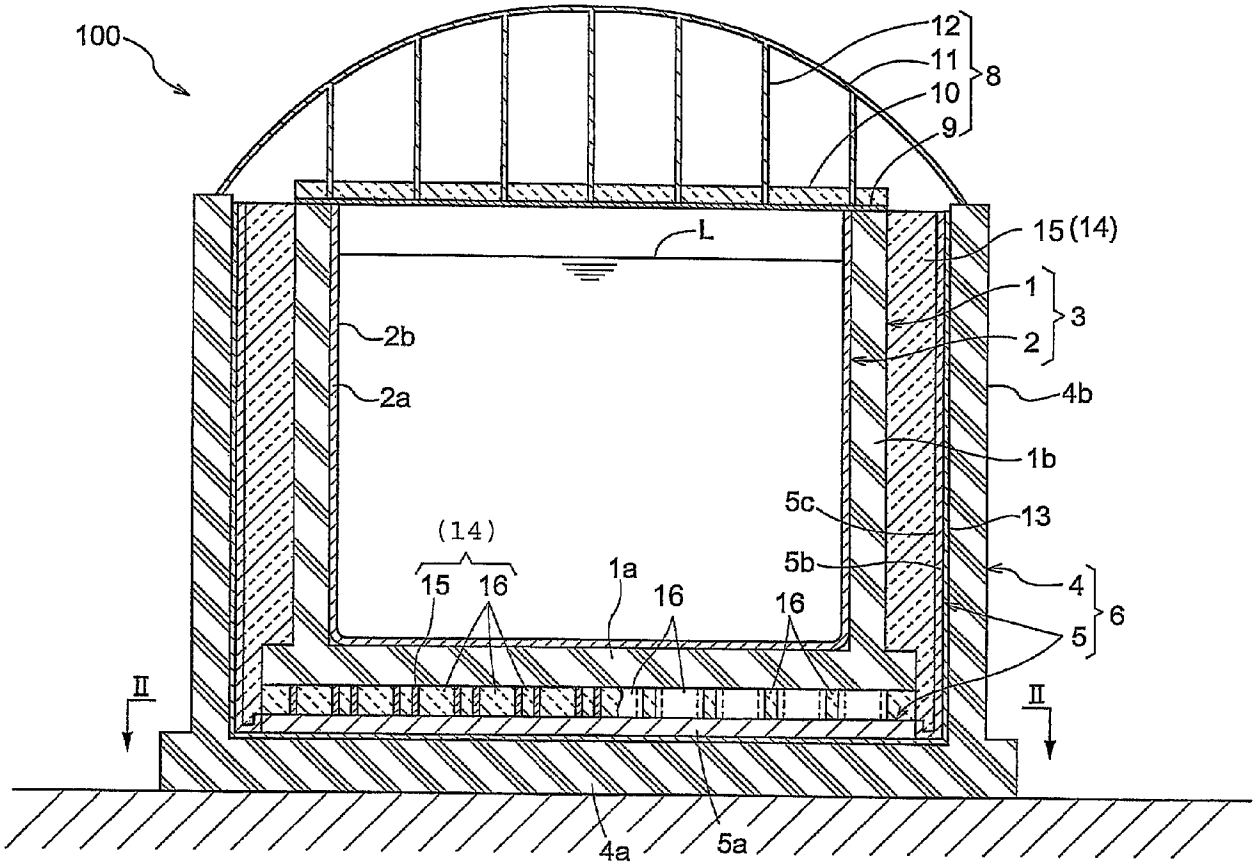
FIG. 1 is a section view of a cryogenic tank according to the present invention.
Figure 2:
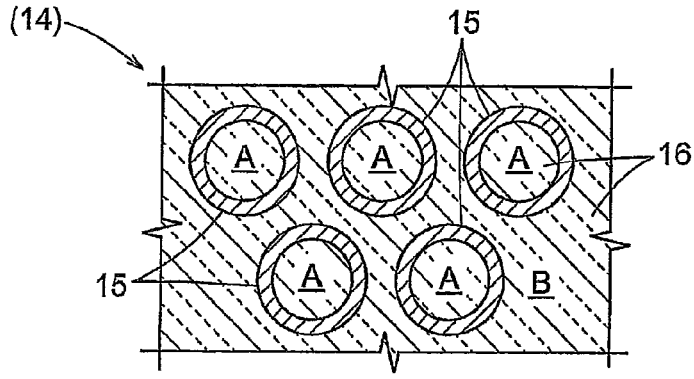
FIG. 2 is an enlarged view in section of an insulation taken along II-II line in FIG. 1.

As shown in FIG. 1, a cryogenic tank 100 according to the present invention comprises a dual construction cryogenic tank 100 including an inner tank 3 for storing therein LNG L (an example of low-temperature liquefaction fluid: −160° C. approximately), an outer tank 6 for enclosing the bottom portion and the shell of the inner tank 3 from the outside, and an insulation 14 interposed between the inner tank 3 and the outer tank 6. These inner and outer tanks 3 and 6 have approximately cylindrical shape with open top and a reservoir portion formed therein. That is, in the cryogenic tank 100 of the present invention, the inner tank 3 and the outer tank 6 enclosing it have hollow cylindrical shape, and the LNG L can be stored within the inner tank 3.

Though will be described in greater details later, the inner tank 3 consists essentially of an inner vessel 1 formed of concrete and configured for storing the LNG L therein and an inner cold resistant relief 2 covering the inner face of the inner vessel 1. The outer tank 6 consists essentially of an outer vessel 4 formed of concrete and configured for enclosing the inner tank 3 and an outer cold resistant relief 5 covering the inner face of the outer vessel 4. Hence, with this construction, the inventive cryogenic tank 100 is capable of storing therein the low temperature LNG L for an extended period of time.

Upwardly of the inner tank 3 and the outer tank 6, there is provided a lid portion 8 for shielding their insides from the outside. This lid portion 8 includes, in the order from the lower side thereof, a ceiling plate 9 having good toughness against low temperature associated with the LNG L, an insulation 10 for restricting transfer of cold heat to the outside of the inner tank 3, and a dome-shaped roof 11 forming, relative to the insulation 10, a space to be filled with gas evaporated from the LNG L. This dome-like roof 11 is supported, with its outer peripheral portion being placed in contact with the top face of the outer tank 6 and there are disposed a plurality of struts 12 extending upward perpendicularly.

As a material for forming the ceiling plate 9, a metal such as aluminum steel, aluminum alloy having superior toughness against cold heat can be suitably employed. As the insulation 10, a material having relative low heat conductivity, such as glass wool, can be suitably employed. As material for forming the dome-like roof 11 and the struts 12, relatively less costly material such as carbon steel, etc. can be suitably employed.

The inner tank 3 consists essentially of the inner vessel 1 formed of concrete and configured for storing the LNG L therein and the inner cold resistant relief 2 covering the inner face of the inner vessel 1. More particularly, in the inner tank 1, its inner vessel bottom portion 1*a* (corresponding to "bottom base") forming the lower face which is a horizontal face, is comprised of reinforced concrete (RC). And, its inner vessel shell portion 1*b* forming the lateral wall which is a perpendicular face is comprised of a PC. RC and PC are concrete materials with enhanced resistance against tensile stress. With such concrete materials, even when there is generated a tensile stress due to cold heat shock by the low temperature LNG L, occurrence of cracks or the like can be restricted.

The rebar constituting the RC is a rebar which satisfies the specified values shown below when the above-described notch elongation test provided under EN14620 (described in paragraph [0014] hereinbefore) is conducted with using 1 mm V-notched or non-notched samples. For example, for use at −165° C., a rebar which has received aluminum deacidification treatment with blast furnace material is suitably employed.

[Notch Elongation Test]

In the evaluation of tenacity and toughness of the rebar, the elongation test will be conducted with using a 1 mm V-notched or non-notched rebar under the designed lowest operating temperature (from −160° C. to 20° C.). And, the rebar should satisfies the requirements (conditions) of the following items.

Condition (a): non-notched breaking elongation (100 mm or more distance between gauge points away by 2 d or more from the breaking position) should be at or greater than 3.0%, where d is the diameter of the rebar; and Condition (b): notch sensibility ratio (NSR) should be 1.0 or greater.

[Mathematical Formula 1]

$$NSR = \frac{\text{(tensile strength of notched sample)}}{\text{(0.2\% proof stress or yield stress of non-notched sample)}}$$

As a result, there can be obtained an inexpensive, yet highly reliable cryogenic tank, using mainly concrete, not metal for low temperature, in forming its inner vessel.

Incidentally, in the above-described notch elongation test, the upper limit values of "non-notched breaking elongation" and "notch sensibility ratio" of the rebar for use in the concrete forming the inner vessel will be restricted by physical property limit values of the material (i.e. rebar with aluminum deacidification treatment). Hence, as long as the value is at or greater than the specified lower limit value, any rebar available that has a value at or higher than this specified lower limit value can be employed.

Figure 3:
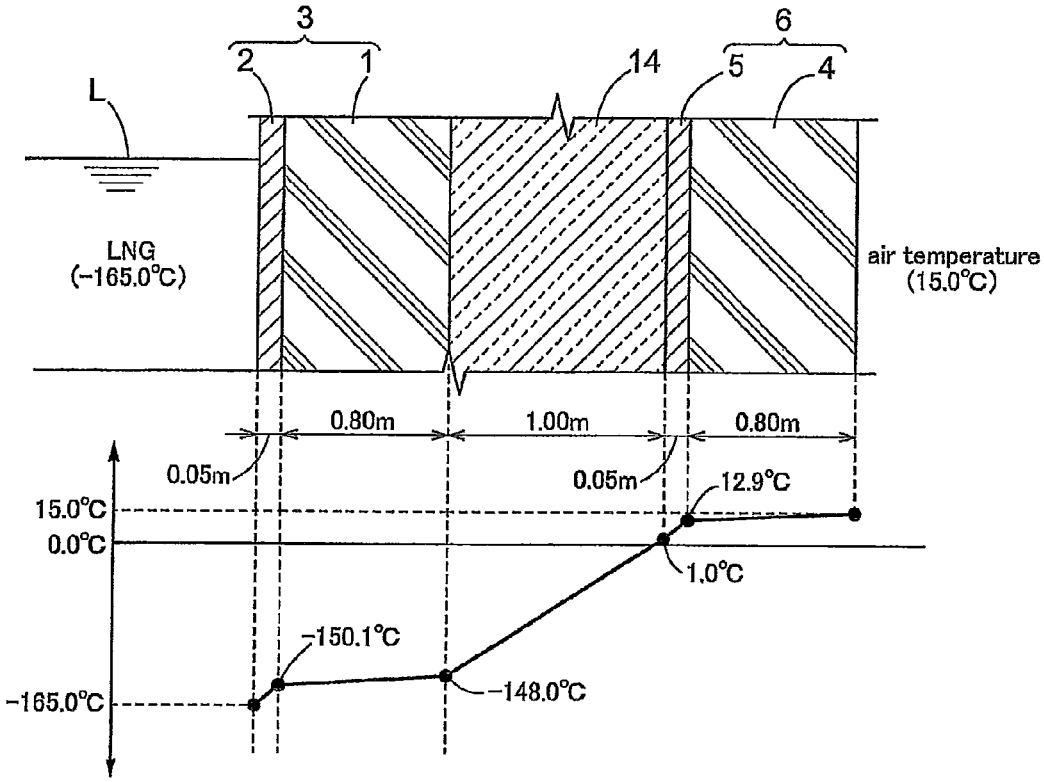
FIG. 3 is a temperature distribution diagram of a shell at the time of normal operation.
Figure 4:
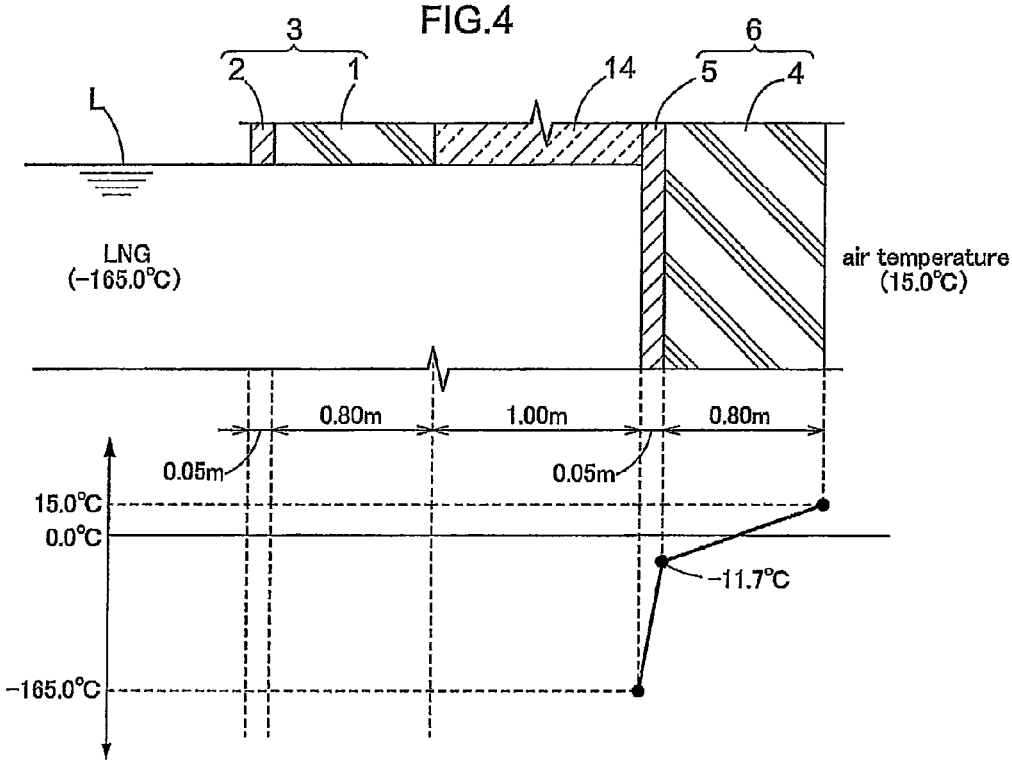
FIG. 4 is a temperature distribution diagram of the shell at the time of emergency (leakage)
Figure 5:
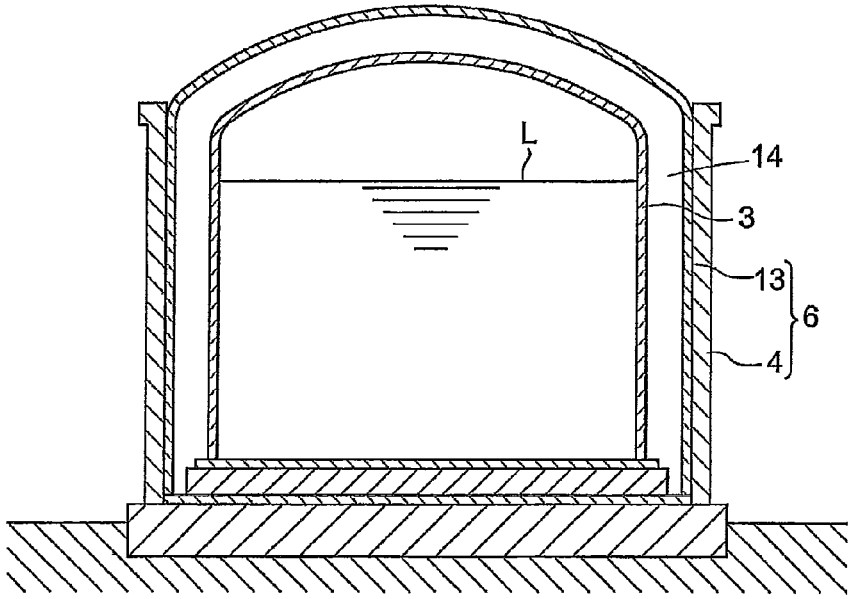
FIG.5 PRIOR ART
FIG. 5 is a section view of a conventional cryogenic tank.

On the other hand, referring to some specific examples of the temperate of the concrete forming the outer vessel, in the case of −165° C. LNG, the temperature is about 13° C. as shown in FIG. 3 Even at the time of emergency of liquid leakage, the temperature is still about −12° C., as shown in FIG. 4, which is at or higher than −20° C. and relatively close to the room temperature. For this reason, for this concrete forming the outer vessel, the standard concrete for rebar specified under e.g. JIS G3112, can be suitably employed.

The inner cold resistant relief 2 is provided for restricting transfer of cold heat shock or temperature change due to the low temperature natural gas L on the inner face of the inner vessel 1 (the side of LNG L in FIG. 1). This inner cold resistant relief 2 is formed of polyurethane foam 2*a* having relatively low heat conductivity and glass mesh 2*b* disposed on the surface of the urethane foam as a surface reinforcing material. This glass mesh 2*b* has good resistance against stress associated with cold heat shock, thus being capable of preventing occurrence of damage such as a crack in the polyurethane foam 2*a*.

With the arrangements described above, the cold heat shock or temperature change due to the low-temperature LNG L can be effectively absorbed by the polyurethane foam 2*a* and transfer thereof to the inner vessel 1 can be effectively restricted. Also, as the glass mesh 2*b* reinforces the surface of the polyurethane foam 2*a*, there has been realized the inner cold resistant relief 2 capable of effectively preventing occurrence of damage such as a crack.

The thickness of the polyurethane foam 2*a* and the scale spacing of the glass mesh 2*b* will be determined as follows, in case the low-temperature liquefaction fluid to be stored in the cryogenic tank 100 is LNG L (about −160° C.).

For instance, the thickness will be set to be at or greater than 30 mm and smaller than 100 mm, in order to sufficiently restrict transfer of cold heat shock due to the LNG L to the inner vessel 1 formed of concrete. With this, the polyurethane foam 2*a* is allowed to provide its heat insulating effect for a long period of time appropriately.

The scale spacing of the glass mesh 2*b* will be set to 2 mm, in order to appropriately restrict occurrence of damage such a crack in the surface of the polyurethane foam 2*a*. Meanwhile, preferably, the scale spacing of the glass mesh 2*b* at its portion to be exposed directly to the LNG L will be set to 10 mm, while its corner portions at the shell and the bottom portion should be formed as glass cloth lining. With this, occurrence of crack or the like in the polyurethane foam 2*a* can be effectively prevented and even if crack should occur, its spreading to the periphery can be restricted to a relative small area.

Eventually, the thickness of the inner cold resistant relief 2 is set as such thickness as to prevent local temperature reduction at the inflow velocity of the LNG L in the situation of the LNG L (about −160° C.) flowing into the inner vessel 1.

Next, a method of setting up the cold resistant relief 2 will be explained.

Though not shown, for forming the polyurethane foam 2*a* constituting the inner cold resistant relief 2, a gondola will be set along the inner face of the inner tank 3 and an amount of urethane foam is sprayed onto the inner face of the inner vessel 1 to a predetermined thickness. Then, a machining operation is effected on the sprayed surface for rendering it smooth and then an amount of adhesive agent is sprayed thereon, on which the glass mesh 2*b* is bonded, thus forming the predetermined cold resistant relief.

According to another possible method, the glass mesh 2*b* in the form of a roll is attached to the gondola set along the inner face of the inner tank 3 and then the glass mesh 2*a* sheet is paid out to the predetermined thickness onto the inner face of the inner vessel 1, and an amount of urethane foam is charged uniformly therebetween, thus forming the predetermined cold resistant relief integrally (see Patent Document 2).

Next, the outer tank 6 will be explained. This outer tank 6 too employs a construction basically similar to that of the inner tank 3.

That is, the outer tank 6 consists essentially of an outer vessel 4 formed of concrete and an outer cold resistant relief 5 covering the inner face (the side of the inner vessel 1 in FIG. 1) of this outer vessel 4.

In the outer vessel 4, its outer vessel bottom portion 4*a* forming the lower face is comprised of a reinforced concrete (RC) and its outer vessel shell portion 4*b* forming the shell portion is formed of PC.

Referring next to the outer cold resistant relief 5, the inner face (bottom side cold resistant relief) of its outer vessel bottom portion 4*a* is formed of perlite concrete portion 5*a* which is an inorganic substance having good heat insulating performance and the inner face of its outer vessel shell portion 4*b* (the shell side cold resistant relief) is formed of a polyurethane foam 5*b* and a glass mesh 5*c* acting as a surface reinforcing material therefor.

And, between the outer vessel 4 and the outer cold resistant relief 5, there is provided an outer shell 13 made of metal and having a liner construction. This outer shell 13 made of metal and having a liner construction serves to prevent permeation of moisture content from outside to the insulation 14.

Incidentally, the construction and the method of setup of the outer cold resistant relief 5 are substantially identical to those of the inner cold resistant relief 2 described above, and therefore description thereof will be omitted.

And, the inner cold resistant relief 2 is configured as a cold resistant relief formed integrally with and covering the entire inner face of the inner vessel 1. On the other hand, the outer cold resistant relief 5 is comprised of the bottom side cold resistant relief provided on the inner face of the bottom of the outer vessel 4 and the shell side cold resistant relief provided on the inner face of the shell portion of the outer vessel 4.

With the above-described construction, even if the LNG L should leak from the inner tank 3, this leaked fluid can be appropriately retained on the inner side of the outer tank 6, thus preventing leakage thereof to the outside of the outer tank 6.

As described hereinbefore also, between the inner tank 3 and the outer tank 6, there is provided the insulation 14 for restricting diffusion of cold heat of the LNG L to the outside of the inner tank 3. For this insulation 14, between its inner vessel shell portion 1*b* and the outer vessel shell portion 4*b*, a perlite concrete 15 (as an example of solid insulation) in the hollow cylindrical form and a FOAMGLAS or perlite concrete 15 etc. (an example of solid insulation) may be employed suitably. Incidentally, the particulate perlite 16 is charged also to the portion B outside the hollow portion, in addition to the hollow portion A of the above-described hollow cylindrical perlite concrete 15.

With the above, transfer of the cold heat of the LNG L can be confined to the inner tank 3, by means of the insulation 14 provided on the outer side of this inner tank 3.

Next, various conditions of the cryogenic tank 100 according to the present invention will be described, separately for its normal operational condition and the emergency condition, with reference to FIG. 3 and FIG. 4, respectively. Incidentally, in FIGS. 3 and 4, illustration of the outer shell 13 disposed in the shell of the outer tank 6, between the outer vessel 4 and the outer cold resistant relief 5, is omitted, as this is not directly related to the heat insulating performance. Under the normal operating condition, an amount of LNG L is stored inside the inner tank 3. Referring to the temperatures, in case the temperature of the LNG L is −165.0° C., the temperature of the outside of the inner cold resistant relief 2 is −150.1° C., and the temperature of the outside of the inner vessel 1 is about −148.0° C. That is, the temperature of the inner tank 3 is substantially equal to the temperature of the LNG L. As to the size of the inner tank 3, this size is reduced with the reduction in temperature, as compared with the size at the time of room temperature condition. Also, with the inner side cold resistant relief 2, development of local temperature difference in association with introduction/discharge of the LNG L is restricted.

On the other hand, as to the insulation 14 provided in the periphery of the inner tank 3, its outside temperature is 1.0° C., whereas its inside temperature is maintained at −148.0° C., thus transfer of the cold heat of the LNG L to the outside of the inner tank 3 is effectively restricted. For this reason, the outer tank 6 is maintained at a temperature relatively close to that outside the outer tank 6, so, the amount of contraction or the like occurring therein is relatively small. For this reason, the inner tank 3 is located on the radially inner side relative to the outer tank 6, in association with the contraction due to the temperature change.

Incidentally, the insulation 14 interposed between the inner tank 3 and the outer tank 6 effectively restricts transfer of the hot heat outside the outer tank 6 from the outside to the inside of this outer tank 6.

Next, the emergency condition will be described with reference to FIG. 4. Here, the term "emergency" refers herein to such a situation as occurrence of leakage of the LNG L, due to generation of a crack or the like for some cause in the inner tank 3 after its use for an extended period of time.

In such emergency condition, as shown in FIG. 4, the LNG L will leak from the inner tank 3. This LNG L is temporarily retained by the outer tank 6 comprised of the outer vessel 4 and the outer cold resistant relief 5. In particular, as the outer cold resistant relief 5 restricts cold heat shock and/or local temperature variation, the outer vessel 4 made of lateral PC having liquid tightness and the outer vessel bottom portion 4*a* provided at the bottom portion and formed of reinforced concrete (RC), leakage of the LNG L to the outside of the outer tank 6 is effectively prevented. In this, the LNG L will be evaporated by the hot heat from the outside of the outer tank 6. And, this evaporated natural gas will diffuse to the outside of the outer tank 6 via a gas diffusing valve (not shown), thus preventing application of excessive pressure due to the evaporated gas to the outer tank 6. In this way, even at the time of emergency, the LNG L can be appropriately stored in the cryogenic tank 100 at least for a predetermined time period.

Other Embodiments

Next, some other embodiments of the present invention will be described.

(A) In the foregoing embodiment, the low temperature liquefied gas was described as LNG L. However, any other low temperature liquefied gas too can be stored appropriately. For instance, LPG, LEG too can be stored appropriately and effectively.

Figure 6:
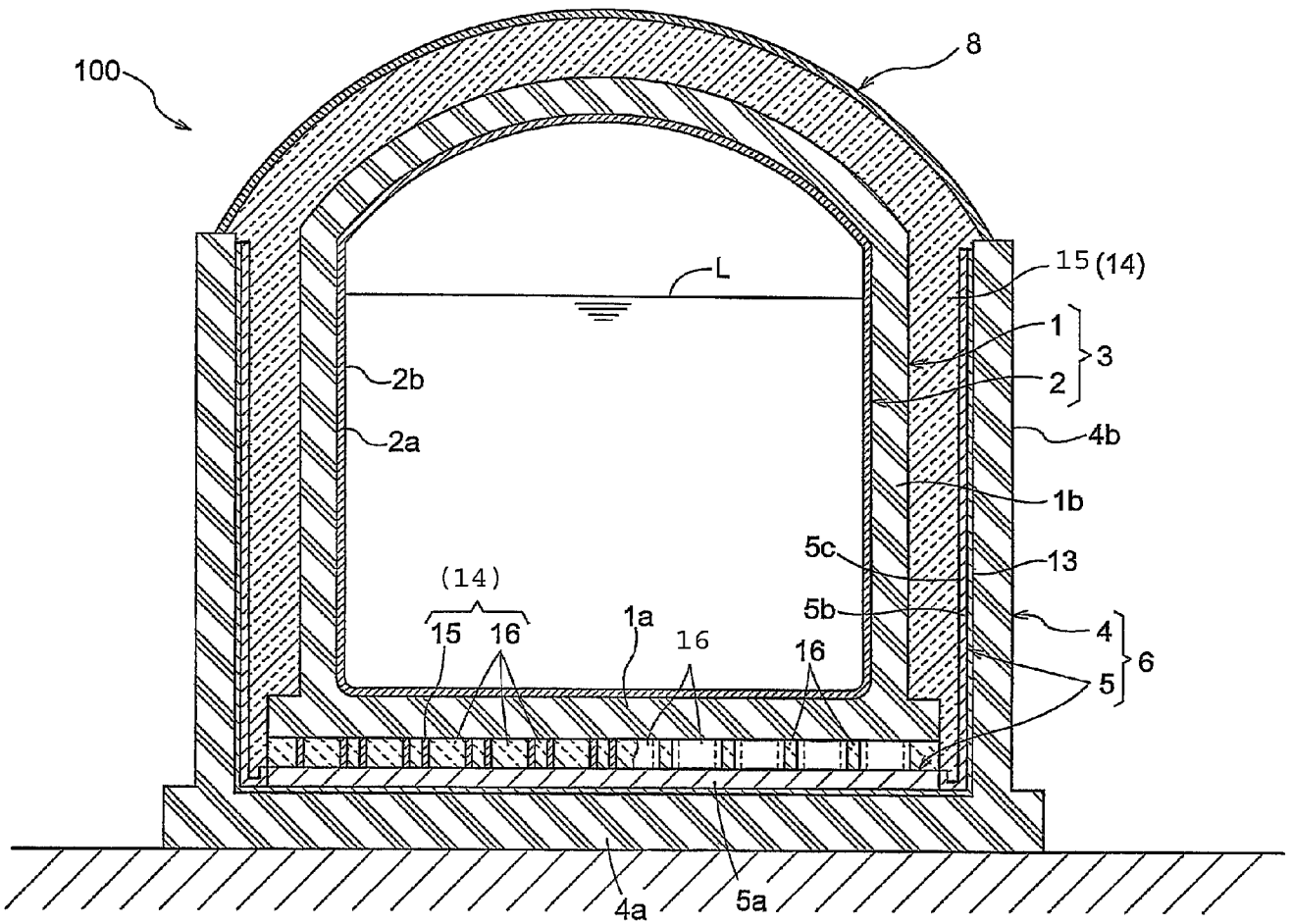
FIG. 6 is a section view showing a cryogenic tank according to a further embodiment of the present invention.

(B) In the foregoing embodiment, the cryogenic tank 100 of the present invention was described as having the lid portion 8 at the top thereof. However, any other construction is also possible. For instance, the cryogenic tank can be configured as a hollow cylindrical tank wherein the inner tank 3 or the inner and outer tanks 3 and 6 includes (include) the upper end portion integrally therewith (see FIG. 6). Further, as to the construction of the lid portion 8, the above-described ceiling, dome-shaped roof 11 having the insulation 10 is most preferred. However, a lid portion 8 having a dome-like roof structure formed of cold-resistant metal material can be used instead of the ceiling, dome-shaped roof 11.

Figure 7:
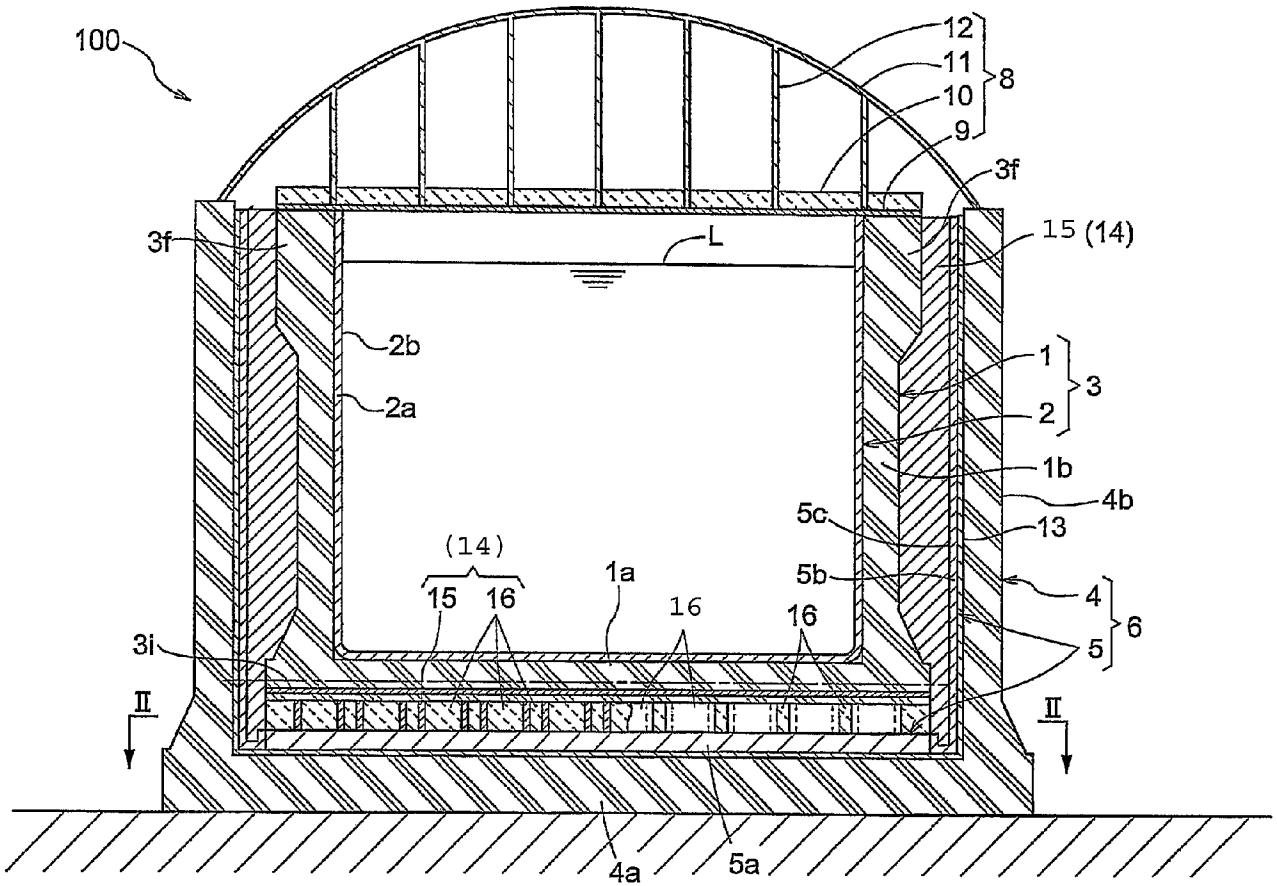
FIG. 7 is a section view showing a cryogenic tank according to a further embodiment of the present invention.

(C) In the cryogenic tank 100 illustrated in the foregoing embodiment, the inner tank 3 thereof has a construction whose thickness is uniform throughout its vertical length. Instead, as shown in FIG. 7, in order to effectively restrict generation of tensile stress at the time of reception of the low-temperature liquefaction fluid L, those portions which are more likely to cause significant bending deformation may be formed with increased thickness. That is, at the upper opening edge of the inner vessel shell portion 1*b* of the inner tank 3, an opening side shell portion 3*f* as such increased thickness portion may be formed, whereby deformation of the upper opening edge of the inner vessel shell portion 1*b* of the inner tank 3 can be effectively restricted and the amount of deformation due to cold stress can be decreased, thus achieving increased strength. In the example illustrated in FIG. 7, the ⅓ area in the vertical direction of the tank is provided with 1.5 times greater thickness, thus forming what is defined herein as a "circular thick portion".

Figure 8:
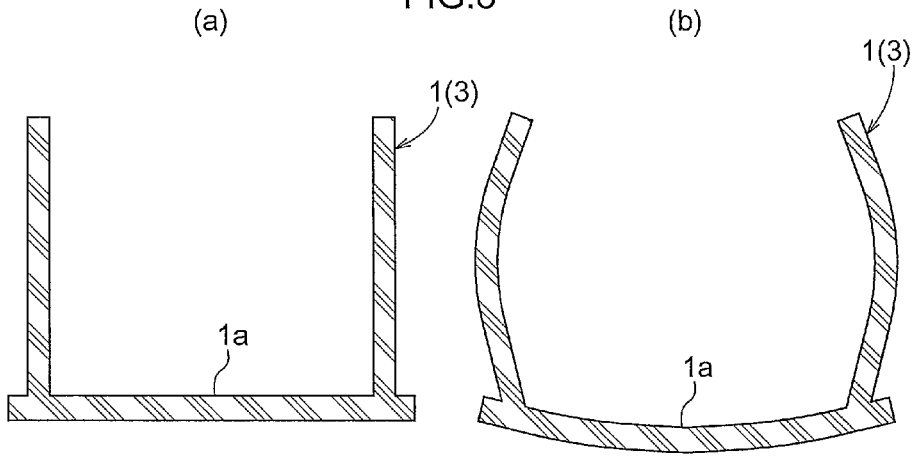
FIG. 8 is an explanatory diagram explaining deformed condition of the conventional cryogenic tank at the time of reception of low temperature liquefied fluid.
Figure 9:
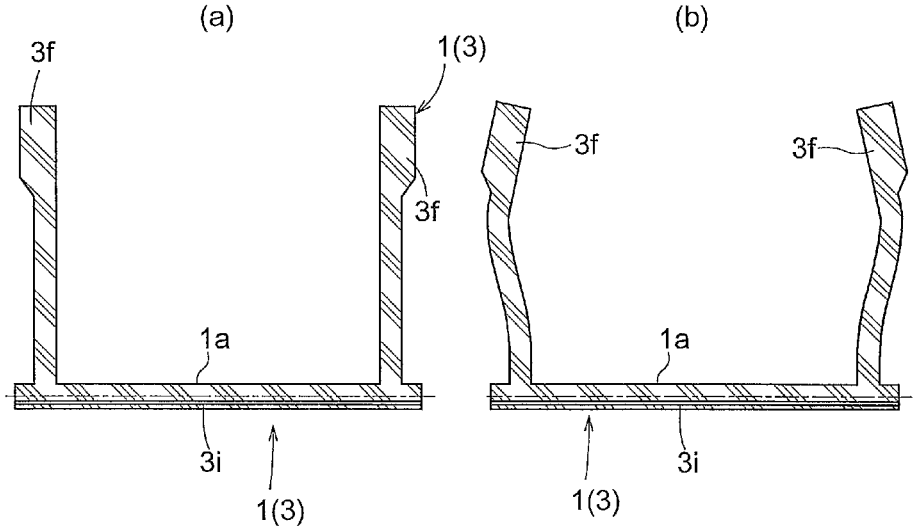
FIG. 9 is an explanatory diagram explaining deformed condition of the inventive cryogenic tank at the time of reception of low temperature liquefied fluid.

(D) Further, as described hereinbefore with reference to FIG. 8, the inner vessel bottom portion 1*a* tends to be subjected to the mode of deformation where the central portion "sinks" relative to the peripheral edge portion at the time of reception of the low-temperature liquefaction fluid L. To cope with this, the following arrangements are possible. Namely, (a) under the normal temperature condition prior to introduction of the low-temperature liquefaction fluid, the central portion of the bottom portion is formed as a center convex shape which extends upward in the tank height direction relative to the shell portion connecting peripheral edge portion thereof. This arrangement can alleviate the above problem. Further, (b) as shown in FIG. 7, a rebar 3*i* introduced to the bottom portion may be disposed upwardly of the vertical center (denoted with the one dot chain line) of the center of the cross section of the bottom portion in the height direction of the tank. This arrangement too can alleviate the above problem.

(E) In the foregoing embodiment, the insulation 14 is disposed evenly along the entire vertical length of the inner vessel shell portion 1*b*. In this regard, when the low-temperature liquefaction fluid L is to be introduced into the cryogenic tank 100, the fluid is to be charged progressively from the lower portion to the upper portion of the cryogenic tank 100. Therefore, it is possible to provide a insulation 14 of increased thickness adjacent the lower portion of the inner vessel shell portion 1*b* and to provide a thin insulation 14 or not to provide any insulation 14 at all adjacent the upper portion thereof. This arrangement achieves particularly high load bearing capacity against cooling associated with the introduction of the low-temperature liquefaction fluid L into the cryogenic tank 100.

INDUSTRIAL APPLICABILITY

The cryogenic tank according to the present invention can be effectively used as a cryogenic tank capable of storing low-temperature liquefaction fluid for an extended period of time while reducing the time and costs required for its setup.

DESCRIPTION OF REFERENCE MARKS

1: inner vessel
2: inner cold resistant relief
2*a*: polyurethane foam
2*b*: glass mesh
3: inner tank
4: outer vessel
5: outer cold resistant relief
5*a*: perlite concrete
5*b*: polyurethane foam
5*c*: glass mesh
6: outer tank
9: ceiling plate
10: insulation
11: dome-shaped roof
14: insulation
L: LNG (an example of low-temperature liquefaction fluid)
100: cryogenic tank
3*f*: thick portion

The invention claimed is:

1. A cryogenic tank having a dual construction with an inner tank for storing low-temperature liquefaction fluid therein, an outer tank enclosing a bottom and a shell portion of the inner tank, and an insulation interposed between the inner tank and the outer tank, wherein said inner tank includes a bottomed inner vessel comprising concrete and an inner cold heat resistant relief covering an inner face of the bottomed inner vessel;

said outer tank includes a bottomed outer vessel comprising concrete and an outer cold heat resistant relief covering an inner face of the bottomed outer vessel;

said outer cold heat resistant relief includes a bottom side cold heat resistant relief provided on an inner face of a bottom of said bottomed outer vessel; and on top of the bottom side cold heat resistant relief comprising perlite concrete, there is disposed a bottom base for the bottomed inner vessel comprising concrete, via an insulation comprising at least one perlite concrete in a hollow tubular form and a particulate perlite charged in said hollow tubular form.

2. The cryogenic tank according to claim 1, wherein said inner cold heat resistant relief includes a glass mesh which comes into contact with the low-temperature liquefaction fluid and a polyurethane foam on whose surface the glass mesh is provided and which is disposed on a side of the bottomed inner vessel.

3. The cryogenic tank according to claim 1, wherein:

said inner cold heat resistant relief comprises a cold heat resistant relief formed integral with and covering an entirety of the inner face of said bottomed inner vessel, and said cold heat resistant relief includes a glass mesh which comes into contact with the low-temperature liquefaction fluid and a polyurethane foam provided on a surface of said glass mesh and disposed on a side of said bottomed inner vessel; and said outer cold heat resistant relief includes a shell side cold heat resistant relief provided on an inner face of a shell portion of said bottomed outer vessel, said bottom side cold heat resistant relief comprising of perlite concrete, and said shell side cold heat resistant relief includes a glass mesh, and a polyurethane foam provided on a surface of said glass mesh, wherein said polyurethane foam is disposed on a side of said bottomed inner vessel.

4. The cryogenic tank according to claim 1, wherein said bottomed inner vessel has an open top, and wherein the cryogenic tank further comprises a ceiling plate for sealing the open top and a dome-shaped roof for covering the outer tank including the ceiling plate from above; and in the shell portion of said bottomed inner vessel, said insulation between said inner tank and said outer tank comprises solid insulation and on side of the ceiling plate facing the dome-shaped roof, there is provided an insulation of comprising solid insulation; and an air heat insulating layer is provided inside said dome-shaped roof.

5. The cryogenic tank according to claim 1, wherein at an upper opening edge of the shell portion of the bottomed inner vessel, there is located an opening side shell portion having a greater thickness than a lower portion of the shell portion of said bottomed inner vessel.

6. The cryogenic tank according to claim 5, wherein the opening side shell portion is located more than halfway up the shell portion of said bottomed inner vessel in the tank height direction.

7. The cryogenic tank according to claim 1, wherein:

a bottom portion of the inner tank comprises a flat planar bottom portion having a predetermined thickness; and at least one rebar introduced to the bottom portion is disposed more than halfway down the bottom portion in the height direction of the tank.

* * * * *

UNITED STATES PATENT AND TRADEMARK OFFICE

CERTIFICATE OF CORRECTION

PATENT NO. : 8,757,422 B2
APPLICATION NO. : 13/574439
DATED : June 24, 2014
INVENTOR(S) : Takeyoshi Nishizaki et al.

It is certified that error appears in the above-identified patent and that said Letters Patent is hereby corrected as shown below:

In the Claims:

Column 14, Line 28, Claim 3, delete “comprising of perlite” and insert -- comprising perlite --

Column 14, Line 40, Claim 4, delete “on side” and insert -- on a side --

Column 14, Line 42, Claim 4, delete “of comprising” and insert -- comprising --

Signed and Sealed this
Seventh Day of October, 2014

Michelle K. Lee

Michelle K. Lee
*Deputy Director of the United States Patent and Trademark Office*